United States Patent [19]

Wiegard

[11] 4,111,257

[45] Sep. 5, 1978

[54] SEAL FOR ROTATING HEAT EXCHANGER

[75] Inventor: Klaus Wiegard, Esslingen, Fed. Rep. of Germany

[73] Assignee: Daimler-Benz Aktiengesellschaft, Fed. Rep. of Germany

[21] Appl. No.: 551,857

[22] Filed: Feb. 21, 1975

[30] Foreign Application Priority Data

Feb. 23, 1974 [DE] Fed. Rep. of Germany ..... 2408819

[51] Int. Cl.[2] ..... F28D 19/00

[52] U.S. Cl. ..... 165/9; 277/83; 277/88

[58] Field of Search ..... 165/9; 277/81 R, 83, 277/88

[56] References Cited

U.S. PATENT DOCUMENTS 3,773,105 11/1973 Kondo ..... 165/9

*Primary Examiner*—Albert W. Davis, Jr.

*Attorney, Agent, or Firm*—Craig & Antonelli

[57] ABSTRACT

A sealing system for a rotating heat-exchanger with D-shaped sealing strips which includes a crossarm and an annular portion pressed against a rotating heat-exchanger by an elastic intermediate member which consists of a diaphragm leaf spring matched to the shape of the sealing strip and, for example, of U-shaped or V-shaped cross section, whereby the free end of one leg is connected with the sealing strip; the D-shape of the sealing strip has a preferably straight crossarm as well as a circularly shaped annular portion.

32 Claims, 17 Drawing Figures

SEAL FOR ROTATING HEAT EXCHANGER

The present invention relates to a sealing system for a rotating heat-exchanger preferably consisting of a ceramic honeycomb matrix with D-shaped sealing strips including a crossarm and annular portions which consist of a base plate with sliding material and of a springy intermediate material, which sealing strips are pressed against the rotating heat-exchanger by the elastic intermediate member.

A heat-storing disk is rotatably arranged on a shaft in a housing. Exhaust gases flow from the gas inlet side through the heat-storing disk in the axial direction and thereafter reach the gas discharge side.

The heat-storing disk consists of many axially extending small pipes or channels securely connected with each other and having different, for example, honeycomb-shaped cross-sectional forms, which in their entirety form a honeycomb matrix. The small pipes or channels have a small diameter and slight wall thickness. From the used ceramic material and by the construction of these small pipes or channels from this material the disk receives the physical properties necessary for a regenerative heat-exchanger in addition to its ability to permit the flow therethrough of the gases. In particular, glass ceramics with low thermal coefficients of expansion are suited as material of the honeycomb matrix.

The hot exhaust gas which flows through the heat-storing disk, thereby heats up the honeycomb matrix of the disk and cools itself off at the same time.

The disk itself is set into rotation by a drive system. That section of the disk which has been heated up by the combustion gases, thereby reaches the other side of the housing where air under increased pressure exits. This air is produced by the compressor of the turbine and flows through the heat-storing disk from the air inlet side to the air outlet or discharge side. In the course of this flow through the disk, the air is heated up whereas simultaneously the disk is cooled off.

As a result of the continuous rotation of the disk, a heat-exchange takes place between the hot exhaust gas and the compessor air. The latter is therefore heated up in the desired sense.

The spaces which supply and conduct away the compressed air and the exhaust gas have a cross-sectional shape that is similar in each case to the area of a semicircle. These spaces therefore form channels whose mouths or orifices must abut closely at the disk in order that a mixing of combustion gases and compressor air is prevented. The sealing parts are springy or elastic structural parts which are pressed against the disk.

Known in the prior art are constructions in which the sealing function of the channels is assumed by a common, interconnected seal. On that side of the seals which abut at the rotating disk, a sliding material is necessary, along which the honeycomb matrix of the disk is able to slide.

The heretofore known sealing systems were difficult to manufacture and additionally did not provide the requisite seal. They did not abut sufficiently or warped in case of longer durations of operation so that leakages resulted therefrom, i.e., non-tightnesses occurred.

It is the aim of the present invention to avoid these disadvantages and to provide a seal which also during longer periods of operations remains flat or plane and simultaneously abuts over its entire surface in a plane and close manner at the heat-storing disk.

The underlying problems are solved according to the present invention in that the elastic or springy intermediate member consists of a membrane or diaphragm leaf spring matched to the shape of the sealing strip, which is constructed either U-shaped or V-shaped and is connected with the sealing strip at the free end of one leg thereof, and the D-shape of the sealing strips includes preferably on the warmer side of the generator disk a preferably rectilinear web portion as well as a circularly shaped annular portion. According to a further feature of the present invention, the free end of the other leg of the U-shaped or V-shaped diaphragm of the diaphragm member may elastically abut at a curved abutment surface of the turbine housing. The web of the U-shaped diaphragm may be formed by a round, rectangular or semi-circularly shaped profile which is connected with the adjacent leg ends of the diaphragm leaf spring. It is possible to establish this connection by welding or brazing.

The web of the U-shaped diaphragm leaf spring, however, may be formed also by cranked or offset end portions thereof whose mutually parallelly extending sections are connected with each other, preferably by spot welding, roll-seam (continuous spot) welding, brazing or protective gas (tungsten inert gas) welding.

In order that the legs of the U-shaped or V-shaped diaphragm structural parts on the one hand abut at the curved abutment surface of the turbine housing to provide a good seal and, on the other, press the sealing strip well against the heat-storing disk, an expansion spring preferably secured at the base plate of the sealing strip may engage between the legs of the diaphragm structural parts, which even without the air pressure from the compressor becoming effective, causes an appropriate, satisfactory abutment at the sealing places already beforehand.

The annular portion of the sealing strip may be provided within the area of the crossarm, which is preferably wider than the annular portion, with a cut-out matched to the width of the crossarm, into which the crossarm engages and which is so deep that a gap reducing the width of the annular portion remains between the end edge of the crossarm and the bottom of the cut-out for purposes of thermal expansion.

In order to be able to overcome better the difficulties in the seal at the transition places between the annular portion and the crossarm of the sealing strip, the diaphragm leaf spring parts which are directed against one another at the transition from the annular portion to the crossarm, may mutually overlap and small sliding blocks may be inserted at the separating slot between the crossarm and the annular portion within the area of the webs of the mutually facing diaphragm leaf springs, which blocks slide at one another in case of thermal expansion between the annular portion and the crossarm. Since the overlap of the diaphragm leaf spring parts at the transition places to the seal does not suffice in most cases, the diaphragm leaf spring parts which are directed against one another at the transition from the rear portion to the crossarm, may accommodate therebetween a diaphragm leaf spring part whose inner radius is smaller than the inner radius of the diaphragm leaf spring parts directed against one another. Finally, it is additionally necessary to overcome by a separate special seal the transition from annular portion to annular portion within the area of the web portion. For that purpose, the annular diaphragm includes within the area of the crossarm only legs, between which is inserted a diaphragm leaf spring member whose web becomes smaller toward the center so that the cross-sectional shape of the diaphragm leaf spring member passes over from the U-shape at its ends into V-shape in its center.

Accordingly, it is an object of the present invention to provide a sealing system for a rotating heat-exchanger which avoids by simple means the aforementioned shortcomings and drawbacks encountered in the prior art.

Another object of the present invention resides in a sealing system for a rotating heat-exchanger which can be manufactured in a simple manner, yet ensures the requisite seal under all operating conditions.

A further object of the present invention resides in a seal structure for rotating heat-exchangers which ensure proper operation even when used during longer periods of operation and which eliminate the danger of warping and non-tightnesses.

A still further object of the present invention resides in a sealing system of the type described above which remains flat also during longer periods of operation and abuts uniformly over its entire area in a plane and tight manner at the heat-storing disk.

These and further objects, features and advantages of the present invention will become more apparent from the following description when taken in connection with the accompanying drawing which shows, for purposes of illustration only, several embodiments in accordance with the present invention, and wherein.

Figure 4:
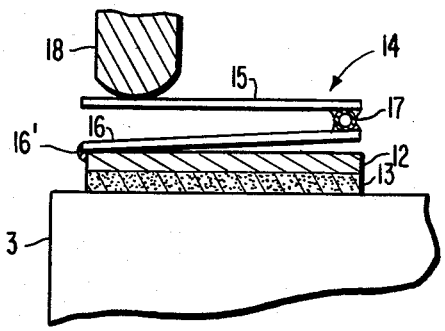
FIG. 4 is a cross-sectional view through the sealing bar with a double diaphragm in accordance with the present invention, taken along line IV—IV in FIG. 2.
Figure 5:
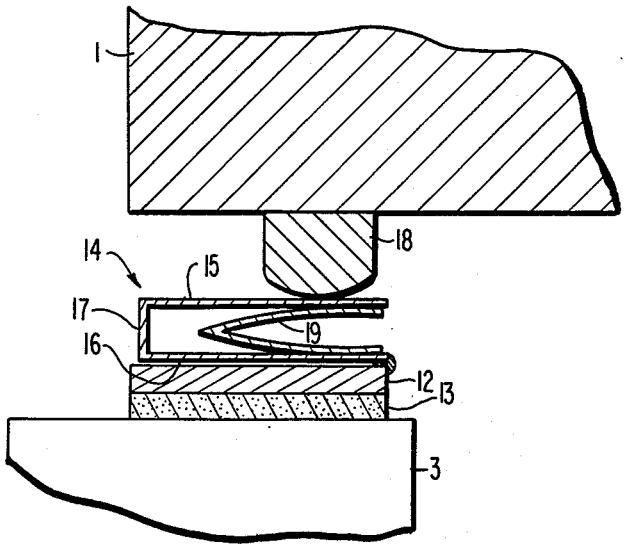
Figure 6:
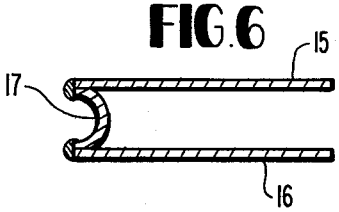
Figure 7:
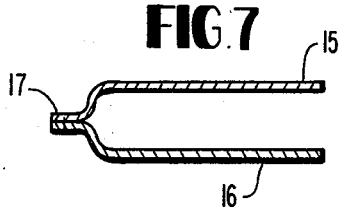
Figure 9:
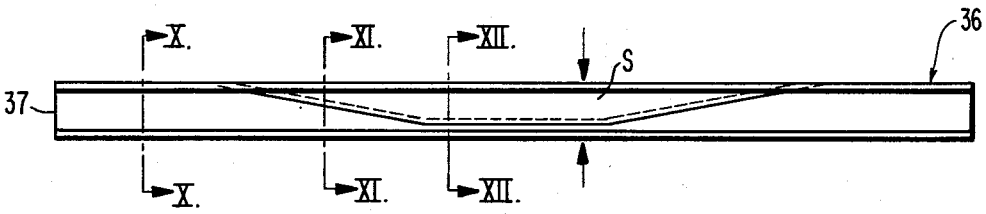
Figure 10:
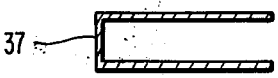
Figure 11:
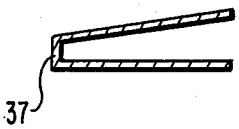
Figure 12:
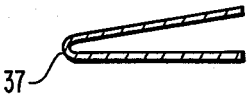
Figures 8, 13:
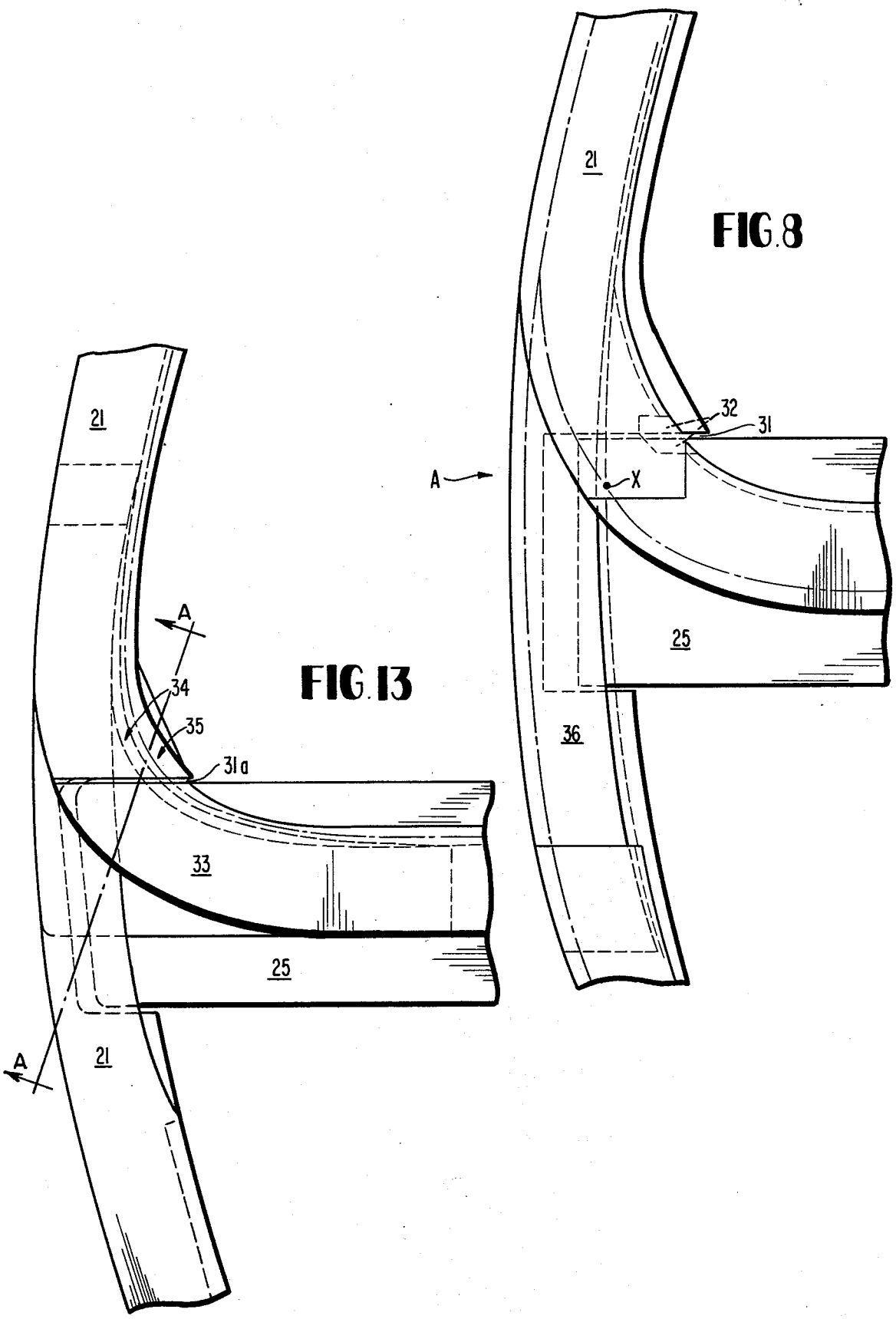
Figure 14:
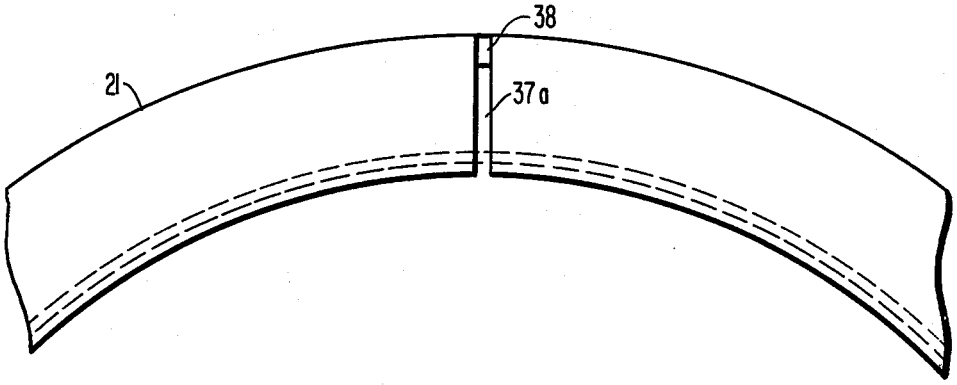
Figure 15:
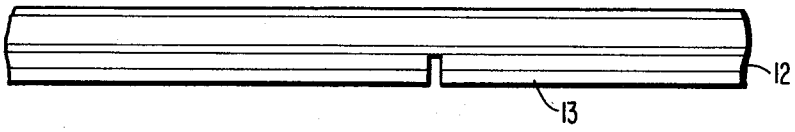
Figure 16:
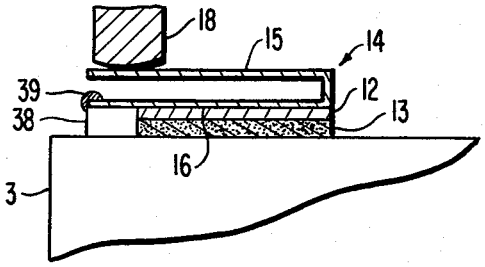
Figure 17:
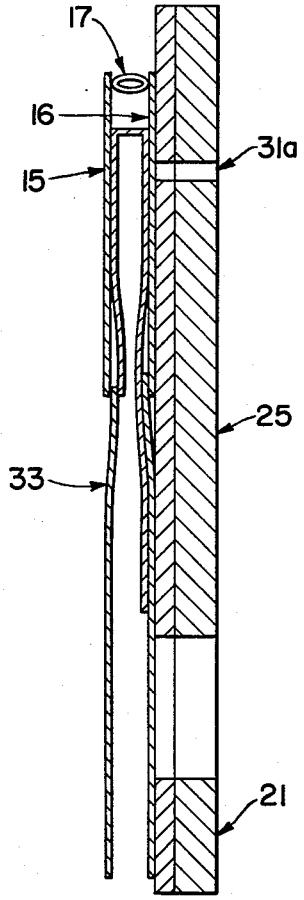

FIGS. 5, 6, and 7 are cross-sectional views, similar to FIG. 4, and illustrating different embodiments of the double diaphragm in accordance with the present invention;

FIG. 8 is a partial elevational view illustrating the transition from the annular portion to the crossarm of the sealing strip in accordance with the present invention;

FIG. 9 is a side view, taken in the direction of arrow A, on the partial diaphragm member inserted at the transition place;

FIG. 10 is a cross-sectional view taken along line X—X of FIG. 9;

FIG. 11 is a cross-sectional view taken along line XI—XI of FIG. 9;

FIG. 12 is a cross-sectional view taken along line XII—XII of FIG. 9;

FIG. 13 is a partial elevational view on a modified embodiment of the transition from the annular portion to the crossarm in accordance with the present invention;

FIG. 14 is a partial elevational view illustrating the construction of an expansion gap in accordance with the present invention;

FIG. 15 is a top plan view on the construction of the expansion gap illustrated in FIG. 14;

FIG. 16 is a partial cross-sectional view through the construction of the expansion gap illustrated in FIGS. 14 and 15;

FIG. 17 is a cross-sectional view taken along line A—A of the annular portion of the modified embodiment shown in FIG. 13 in accordance with the present invention.

Referring now to the drawing wherein like reference numerals are used throughout the various views to designate like parts, a heat-storing disk 3 constructed as honeycomb matrix is rotatably arranged in a housing 1 on a shaft 2. Hot combustion gas coming from the turbine flows through the space 4 which represents a channel semi-circularly shaped in cross section, whereby the combustion gas is under a pressure of about one atmosphere. This exhaust gas also flows through the disk 3 in the axial direction from the gas inlet (GE) toward the gas outlet (GA). The honeycomb matrix of the disk 3 is thereby heated up and the gas is cooled off. It reaches the space 5 of the housing 1 which is also semi-circularly shaped in cross section and from there flows out of the heat-exchanger.

The disk 3 is surrounded by a ring-shaped toothed rim 6 which is form-lockingly connected with the disk 3 by elastic connecting elements 7. The disk 3 can be set into rotation about the shaft 2 by a drive system 8.

During this rotation, that section of the disk which had been heated up by the combustion gases reaches the spaces 9 and 10 of the housing 1 which again represents semi-circularly shaped channels. Air under an increased pressure is present in the space 9 which is produced by the compressor of the turbine. The air flows through the disk 3 from the air inlet side (LE) toward the air outlet side (LA) and reaches the space 10. While flowing through the disk in this manner, the air is heated up whereas the disk 3 is simultaneously cooled off. From the space 10 the heated air then reaches the combustion chamber of the turbine.

The continuous rotation of the disk 3 about the shaft 2 brings about a continuous heat-exchange between turbine gas and compressor air.

Figure 1:
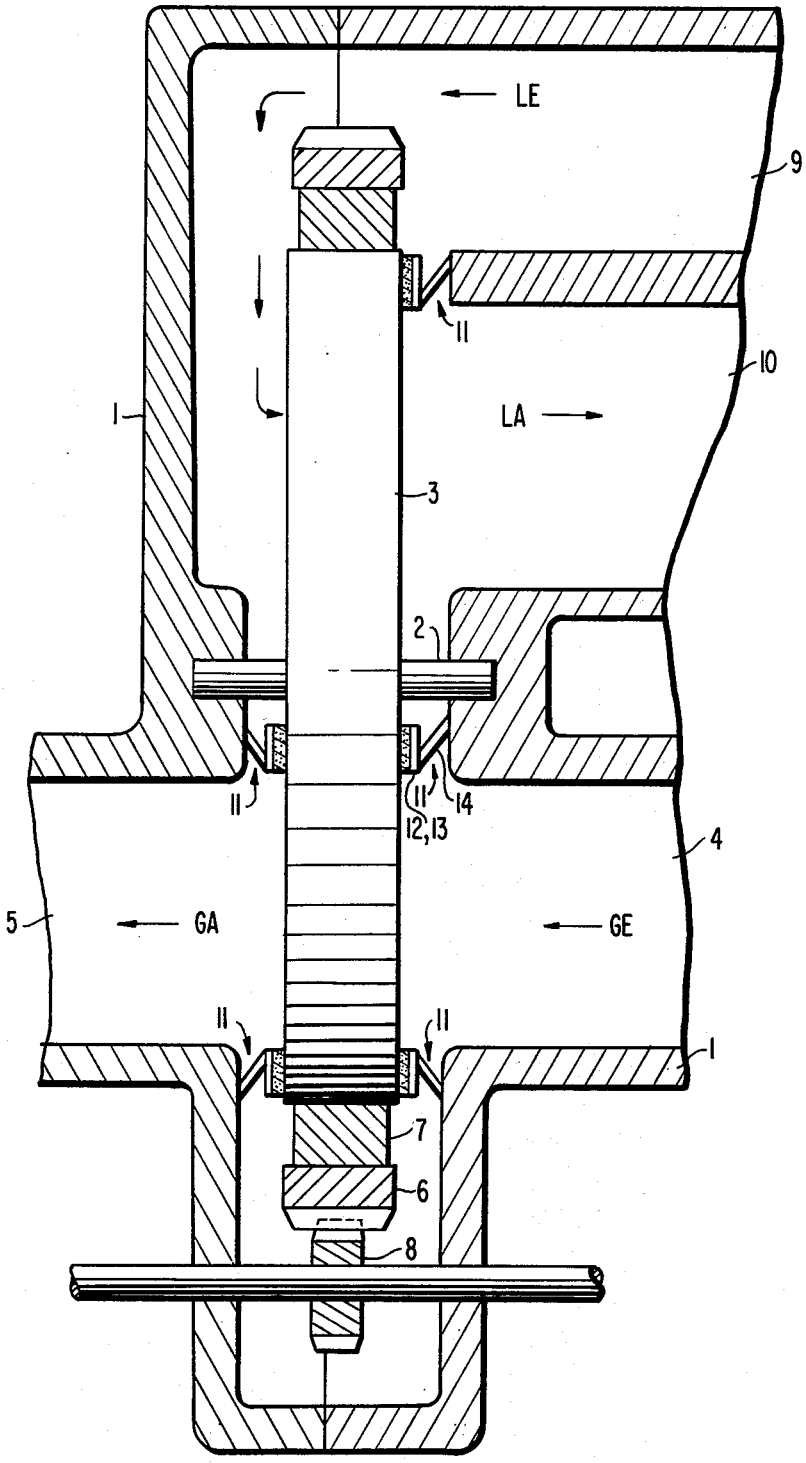
FIG. 1 is a cross-sectional view taken along line I—I in FIG. 2, through a complete heat-exchanger in accordance with the present invention.

The mouths or orifices of the channels 4, 5, 9 and 10 must abut closely at the disk in order that a mixing of combustion gases and compressor air is prevented. The present invention relates to a special construction of the seals generally designated by reference numeral 11 (FIG. 1) which are used for this purpose. They possess a shape similar to the "D".

Known in the art are constructions in which the seals of the spaces 4 and 10 are taken over by a common interconnected seal. These prior art constructions consist of three structural parts. Two of these structural parts are approximately the two halves of a circular ring. This circular ring has an outer diameter that is approximately equal to that of the disk. The third structural part is formed by a bar. This bar is so inserted into the annular ring formed by the two combined annular ring halves that it subdivides the circular area surrounded by the circular ring into two approximately equal circular sections. On that side of the seal which closely abuts at the rotating disk, a sliding material is necessary on which the honeycomb matrix of the disk is able to slide.

The heretofore known constructions of the seals, however, were not satisfactory because with the occurring large temperature differences warpings of the sealing strips and therewith non-tightness occurred readily.

The springy intermediate member for the sealing strip now consists of a diaphragm leaf spring 14 matched to the shape of the sealing strip, properly speaking, which consists of base plate 12 and of a sliding material 13. The diaphragm leaf spring 14 is constructed either U-shaped or V-shaped. In its U-shaped configuration, it includes two legs 15 and 16 as well as a web 17 connecting the same (FIG. 4). The leg 16 of the diaphragm leaf spring 14 which abuts at the base plate 12 is connected at its free end 16' with the base plate 12. The free end of the other leg 15 of the diaphragm leaf spring 14 abuts elastically at a curved abutment surface 18 of the turbine housing 1.

Figure 3:
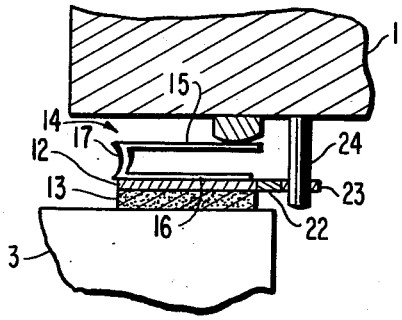
FIG. 3 is a cross-sectional view, taken along line III—III in FIG. 2 and illustrating the mounting of the sealing bar in accordance with the present invention.

As illustrated in FIGS. 4 to 7, the web 17 of the U-shaped diaphragm may be constructed of rectilinear shape (FIG. 5), of circular shape (FIG. 4), of circular ring-shape (FIG. 3), of a divided pipe (FIG. 6), or of cranked-off or offset end portions (FIG. 7) whose mutually parallelly extending sections are connected with each other, preferably by spot-welding, roll seam-welding (continuous spot welding), brazing or protective gas welding. An expanding spring 19 (FIG. 5) preferably secured at the base plate 12 of the sealing strip, may be inserted between the legs 15 and 16 of the diaphragm member 14, which also in case of a not-yet present pressure ensures that the legs 15 and 16 of the diaphragm leaf spring 14 sealingly abut at the base plate 12, on the one hand, and at the abutment surface 18, on the other, and therewith securely press the sliding material 13 against the honeycomb matrix 3.

Figure 2:
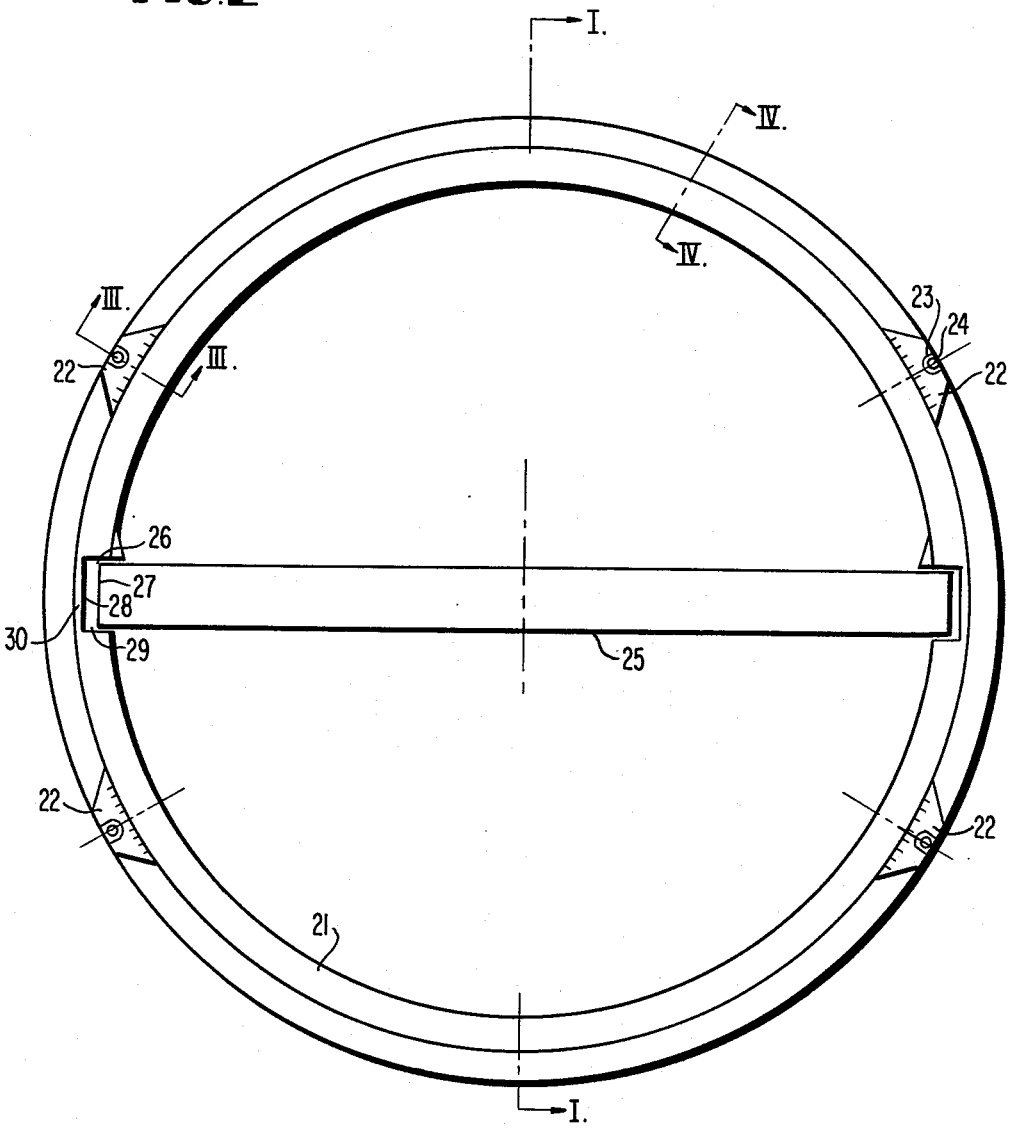
FIG. 2 is an elevational view on the gas inlet-air outlet side of a sealing system according to the present invention.

The annular portion 21 (FIG. 2) of the sealing strip, as to the rest, includes holding tabs 22 (FIGS. 2 and 3) secured at its base plate 12, into the slots 23 of which engage retaining bolts 24 secured at the turbine housing 1. The annular portion 21 of the sealing strip is provided within the area of the web portion 25 (FIG. 2) which is wider than the annular portion 21, with a cutout or recess 26 matched to the width of the web portion 25, into which engages the web portion 25. This cutout 26 is so deep that a gap 29 reducing the remaining width of the annular portion remains free for thermal expansion between the end edge 27 of the web portion 25 and the bottom 28 of the cutout 26. Owing to the reduction of the width of the annular portion 21 within the area of the web portion 25 the narrow strip 30 of the sealing strip which remains thereat, acts like a joint so that as a result thereof the two semi-circularly shaped portions of the sealing strip thereby have an opportunity for differing thermal expansion.

Particularly difficult is the transition from the annular portion 21 to the web portion 25 of the sealing strip in view of the double-diaphragm present within this area which is responsible for the sealing abutment of the sealing strip, on the one hand, at the honeycomb matrix 3 and, on the other, at the abutment surface 18 of the turbine housing 1. For purposes of a facilitated transition at these places, the sealing strips and the diaphragm leaf spring parts, as shown in FIG. 8, are directed against one another by arcuate shapes provided on both sides. The diaphragm leaf spring parts overlap at the transition place and sliding blocks 32 are inserted at the separating slot 31 between the crossarm and the annular portion within the area of the webs of the mutually facing diaphragm leaf springs, which sliding blocks 32 are able to slide one on the other in case of a differing thermal expansion between the annular portion and the crossarm.

On the other hand, as illustrated in FIG. 13, a partial diaphragm leaf spring member 33 may also be inserted between the diaphragm leaf spring parts which are directed against one another at the transition from the annular portion 21 to the crossarm 25, whose inner radius 34 is smaller than the inner radius 35 of the diaphragm leaf spring parts directed against one another. A cross-sectional view of the annular portion 21 and of the crossarm 25 are shown in FIG. 17, taken along line A—A of FIG. 13. Also in this case, a separating slot **31*a*** is provided between the diaphragm leaf spring parts which leaves free a small clearance between these parts in order that the separate diaphragm parts are able to slide past one another easily.

For purposes of a tight transition from the annular portion 21 above and below the crossarm 25, the annular diaphragm member is provided within the area of the web portion 25 exclusively with legs, between which is inserted a partial diaphram leaf spring member 36 (FIG. 9). The web 37 of this partial diaphragm leaf spring member 36 becomes smaller towards the center as is indicated by the cross-sectional views in FIGS. 10 and 12 so that the cross-sectional form of the partial diaphragm leaf spring member 36 passes over from the U-shape at its ends (cross section X—X) into the V-shape in its center (cross section XII—XII). The distance S indicated in FIG. 9 illustrates the path through which the diaphragm is able to spring-deflect at the point X in FIG. 8.

The sealing strip may be separated by a gap **37*a* at several places of the annular portion 21, as illustrated in FIGS. 14 to 16. This gap 37*a* is appropriately bridged over by a spacer leaf 38 at the periphery of the leg 16 of the annular diaphragm abutting at the base plate 12. This small spacer leaf 38 may additionally be covered off by at least one angle member 39** spot-welded to a leg of the annular diaphragm.

While I have shown and described several embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A sealing system for a rotating heat-exchanger which includes a turbine housing, the sealing system comprising a sealing strip means including base plate means and an elastic intermediate means, the sealing strip means being pressed against the rotating heat-exchanger by the elastic intermediate means, characterized in that the elastic intermediate means includes a diaphragm leaf spring means matched approximately to the shape of the sealing strip means and having two leg portions, a free end of one of the two leg portions of the diaphragm leaf spring means being fixedly connected at the base plate means of the sealing strip means, and a free end of the other of the two leg portions of the diaphragm leaf spring means freely elastically abutting a curved abutment surface of the housing.

2. A sealing system according to claim 1, characterized in that the heat-exchanger consists of a ceramic honeycomb matrix.

3. A sealing system according to claim 1, characterized in that the sealing strip means has a crossarm and an annular portion, said crossarm being wider than the annular portion of the sealing strip means.

4. A sealing system according to claim 1, characterized in that the diaphragm leaf spring means is constructed at least approximately U-shaped.

5. A sealing system according to claim 1, characterized in that the diaphragm leaf spring means is constructed at least approximately V-shaped.

6. A sealing system according to claim 1, characterized in that the sealing strip means is D-shaped and, including the crossarm and the annular portion, is arranged on the warmer side of the disk.

7. A sealing system according to claim 1, characterized in that the diaphragm leaf spring means includes a web which is connected with the adjacent ends of the leg portions thereof.

8. A sealing system according to claim 7, characterized in that the last-mentioned web has a round profile.

9. A sealing system according to claim 7, characterized in that the last-mentioned web has a rectangular profile.

10. A sealing system according to claim 7, characterized in that the last-mentioned web has a semi-circularly shaped profile.

11. A sealing system according to claim 7, characterized in that the last-mentioned web of the diaphragm leaf spring means is formed by offset end portions whose mutually parallelly extending sections are securely connected with each other.

12. A sealing system according to claim 7, characterized in that an expansion spring means engages between the leg portions of the diaphragm leaf spring means.

13. A sealing system according to claim 12, characterized in that the expansion spring means is secured at the base plate of the sealing strip means.

14. A sealing system according to claim 7, characterized in that the sealing strip means has a crossarm and an annular portion, said annular portion being provided within the area of the crossarm with a cut-out matched in width to the crossarm, into which engages the crossarm, and said cut-out is so deep that a gap for the thermal expansion which reduces the width of the annular portion, remains free between the end edge of the crossarm and the bottom of the cut-out.

15. A sealing system according to claim 14, characterized in that the crossarm is wider than the annular portion.

16. A sealing system according to claim 14, characterized in that the parts of the diaphragm leaf spring means which are directed against one another at the transition from the annular portion to the crossarm of the sealing strip means, mutually overlap and sliding blocks are inserted at the separating slot between the crossarm and the annular portion within the area of the web of the mutually facing diaphragm leaf spring means, said sliding blocks being able to slide one upon the other during a thermal expansion between the annular portion and the crossarm.

17. A sealing system according to claim 14, characterized in that the parts of the diaphragm leaf spring means which are directed toward one another at the transition from the annular portion to the crossarm, accommodate therebetween a partial diaphragm leaf spring member whose inner diameter is smaller than the inner diameter of the parts of the leaf spring means which are directed against one another.

18. A sealing system according to claim 14, characterized in that the diaphragm leaf spring means includes within the area of the crossarm exclusively leg portions between which is inserted a partial diaphragm leaf spring member whose crossarm becomes smaller toward the center so that the cross-sectional shape of the partial diaphragm leaf spring member passes over from the U-shape at its ends into the V-shape in its center.

19. A sealing system according to claim 14, characterized in that the sealing strip means is separated at several places of the annular portion by a gap which is bridged over by a small spacer leaf at the periphery of the leg portion of the diaphragm leaf spring means abutting at the sealing strip means.

20. A sealing system according to claim 19, characterized in that the spacer leaf is covered off by at least one angular member secured to one leg portion of the diaphragm leaf spring means.

21. A sealing system according to claim 1, characterized in that an expansion spring means engages between the leg portions of the diaphragm leaf spring means.

22. A sealing system according to claim 21, characterized in that the expansion spring means is secured at the base plate of the sealing strip means.

23. A sealing system according to claim 1, characterized in that the sealing strip means has a crossarm and an annular portion, and further characterized in that the parts of the diaphragm leaf spring means, which are directed toward one another at the transition from the annular portion to the crossarm, accommodate therebetween a partial diaphragm leaf spring member whose inner diameter is smaller than the inner diameter of the parts of the leaf spring means which are directed against one another.

24. A sealing system according to claim 1, characterized in that the sealing strip means has a crossarm and an annular portion, and further characterized in that the diaphragm leaf spring means includes within the area of the crossarm exclusively leg portions, between which is inserted a partial diaphragm leaf spring member whose crossarm becomes smaller toward the center so that the cross-sectional shape of the partial diaphragm leaf spring member passes over the the U-shape at its ends into the V-shape in its center.

25. A sealing system according to claim 1, characterized in that the sealing strip means has a crossarm and an annular portion, and further characterized in that the sealing strip means is separated at several places of the annular portion by a gap which is bridged over by a small spacer leaf at the periphery of the leg portion of the diaphragm leaf spring means abutting at the sealing strip means.

26. A sealing system according to claim 25, characterized in that the spacer leaf is covered off by at least one angular member secured to one leg portion of the diaphragm leaf spring means.

27. A sealing system according to claim 1, characterized in that the sealing strip means is approximately D-shaped.

28. A sealing system according to claim 27, characterized in that the diaphragm leaf spring means includes a web which is connected with the adjacent ends of the leg portions thereof.

29. A sealing system according to claim 28, characterized in that the last-mentioned web has a round profile.

30. A sealing system for a rotating heat-exchanger comprising an approximately D-shaped sealing strip means including base plate means with a sliding material and an elastic intermediate means, the sealing strip means being pressed against the rotating heat-exchanger by the elastic intermediate means, characterized in that the elastic intermediate means includes a diaphragm leaf spring means matched approximately to the shape of the sealing strip means and having leg portions, the diaphragm leaf spring means being connected at the free end of one leg portion with the sealing strip means, said free end freely elastically abutting a curved abutment surface of a turbine housing, and the D-shape of the sealing strip means includes a crossarm as well as a substantially circularly shaped annular portion, the annular portion of the sealing strip means is provided within the area of the crossarm with a cut-out matched in width to the crossarm, into which engages the crossarm, and said cut-out is so deep that a gap for the thermal expansion which reduces the width of the annular portion, remains free between the end edge of the crossarm and the bottom of the cut-out.

31. A sealing system according to claim 30, characterized in that the crossarm is wider than the annular portion.

32. A sealing system for a rotating heat-exchanger comprising an approximately D-shaped sealing strip means including base plate means with a sliding material and an elastic intermediate means, the sealing strip means being pressed against the rotating heat-exchanger by the elastic intermediate means, characterized in that the elastic intermediate means includes a diaphragm leaf spring means matched approximately to the shape of the sealing strip means and having leg portions, the diaphragm leaf spring means being connected at the free end of one leg portion with the sealing strip means, said free end freely elastically abutting a curved abutment surface of a turbine housing, and the D-shape of the sealing strip means includes a crossarm as well as a substantially circularly shaped annular portion, the parts of the diaphragm leaf spring means which are directed against one another at the transition from the annular portion to the crossarm of the sealing strip means, mutually overlap and sliding blocks are inserted at the separating slot between the crossarm and the annular portion within the area of the web of the mutually facing diaphragm leaf spring means, said sliding blocks being able to slide one upon the other during a thermal expansion between the annular portion and the crossarm.

* * * * *